US010309600B2

(12) United States Patent
Zhang

(10) Patent No.: US 10,309,600 B2
(45) Date of Patent: Jun. 4, 2019

(54) DAYLIGHT TRANSMISSION SYSTEM FOR BUILDING

(71) Applicant: Xiaodong Zhang, Shandong (CN)

(72) Inventor: Xiaodong Zhang, Shandong (CN)

(73) Assignee: Xiaodong Zhang, Shandong (CN)

( * ) Notice: Subject to any disclaimer, the term of this patent is extended or adjusted under 35 U.S.C. 154(b) by 0 days.

(21) Appl. No.: 15/551,719

(22) PCT Filed: Feb. 16, 2016

(86) PCT No.: PCT/CN2016/073902

§ 371 (c)(1),
(2) Date: Jan. 25, 2018

(87) PCT Pub. No.: WO2016/131419

PCT Pub. Date: Aug. 25, 2016

(65) Prior Publication Data

US 2018/0149324 A1 May 31, 2018

(30) Foreign Application Priority Data

Feb. 17, 2015 (CN) ..... 2015 1 0086318

(51) Int. Cl.
*F21S 11/00* (2006.01)

(52) U.S. Cl.
CPC ..... *F21S 11/005* (2013.01); *F21S 11/00* (2013.01); *F21S 11/007* (2013.01)

(58) Field of Classification Search
CPC ..... F21S 11/005; F21S 11/007
(Continued)

(56) References Cited

U.S. PATENT DOCUMENTS 3,656,844 A * 4/1972 Botskor ..... G05D 3/00 353/3
4,349,245 A 9/1982 Kliman
(Continued)

FOREIGN PATENT DOCUMENTS

CN 2555455 Y 6/2003
CN 1447058 A 10/2003
(Continued)

OTHER PUBLICATIONS

International Search Report issued in corresponding PCT Application No. PCT/CN2016/073902, dated Apr. 28, 2016, pp. 1-4.

*Primary Examiner* — Christopher E Mahoney
(74) *Attorney, Agent, or Firm* — Murtha Cullina LLP

(57) ABSTRACT

A daylight transmission system that can be used in buildings, the system including: dual-axis implementation device, CPU-controller, light position sensor and optical components that include moving and fixed optical components; with the moving optical components including optical light collector and the fixed optical components including first receiver and consecutive receivers. The invented system transmits sunlight in a form of parallel light after it is concentrated and therefore does not rely on expensive medium such as optic fibers, with the entire process being efficient in light transmission and economically viable. With the help of a tracking device, sunlight of any incident angle will be reflected in a fixed direction and to a fixed point where the light is reflected further on to the desired destination inside of a building. The invented system can be installed directly onto the external wall of any building, and be applied within a wide range of buildings.

26 Claims, 5 Drawing Sheets

(58) Field of Classification Search
USPC ..... 359/591
See application file for complete search history.

(56) References Cited

U.S. PATENT DOCUMENTS

| | | | | |
|---|---|---|---|---|
| 4,832,002 | A * | 5/1989 | Medina | F24S 30/455 126/577 |
| 2012/0042868 | A1* | 2/2012 | Huang | F21S 11/00 126/570 |
| 2014/0318600 | A1* | 10/2014 | Walsh | H01L 31/0525 136/246 |
| 2015/0226826 | A1* | 8/2015 | Quero Reboul | F24J 2/38 250/203.4 |
| 2016/0209634 | A1* | 7/2016 | Lauder | G02B 19/0019 |

FOREIGN PATENT DOCUMENTS

| | | | | |
|---|---|---|---|---|
| CN | 102305380 | A | 1/2012 | |
| CN | 103123492 | A | 5/2013 | |
| CN | 203231236 | U | 10/2013 | |
| CN | 204576277 | U | 8/2015 | |
| EP | 2818806 | A1 | 12/2014 | |
| KR | 101021166 | B1 * | 3/2011 | F21S 11/005 |
| WO | 2009052910 | A1 | 4/2009 | |

* cited by examiner

DAYLIGHT TRANSMISSION SYSTEM FOR BUILDING

CROSS-REFERENCE TO RELATED APPLICATIONS

The present disclosure claims priority to PCT Application No. PCT/CN2016/073902 filed on Feb. 16, 2016 and Chinese patent application number 201510086318.0 filed on Feb. 17, 2015, each of which is incorporated by reference herein in its entirety.

TECHNICAL FIELD

This invention is a solar energy device that can be used in buildings in an integrated way to collect and transmit daylight into buildings.

DESCRIPTION OF RELATED ART

The currently most advanced technology in utilizing daylight in buildings is through concentrating sunlight into optic fibers and transmits the light through the fibers into internal space of the buildings. Such systems rely on lens that keep moving and tracing the sun, so that the focal point of the lens fall into the optic fibers and the light is subsequently transmitted by the fiber by total-reflection. Typical products of such systems are the Himawari and Parans systems. These two products both uses moving lens to concentrate sunlight into optic fibers through which the sunlight is transmitted into internal spaces of buildings. The above-mentioned currently available techniques have the following short-comings:

Firstly, these systems require supportive structures that support lens and/or clusters of lens; and the lens, the optic fiber and the supportive structures need to be in constant moves to track the sun, which can be heavy in mass and therefore energy consuming. Such systems also require high-level of mechanical precision to meet the stringent standard of sun-tracking which increases the manufacturing cost of the systems and reduces their commercial availability to many users.

Second, the current techniques rely on one or more sensors that face the sun in the sky, therefore they cannot distinguish sunbeam from diffused light, and hence cannot track the sun with a high precision. Moreover, once the light is in the optic fibers, its direction is diffused and no longer known to the system, therefore the system can utilize no information in terms of the end results of light transmission and therefore cannot adjust the tracking procedure to optimize the orientation of the lens in a closed-cycle way. Therefore, the current systems rely heavily on relaying lens that realign the light which reduces the overall efficiency of the systems making them unsuitable for long-distance light transmission.

Third, the current techniques are poor in economic terms because they employ complicated mechanical structures that are not only costly but also low in efficiency. Especially, these current systems are not suitable for developing countries and areas where population density is high and cost-effective energy saving devices are needed to cut energy consumption and reduce emissions.

SUMMARY

To solve the above-mentioned problems of current techniques in utilizing daylight, this invention intends to provide an economic yet efficient system and method to transmit daylight into buildings. The invented system transmits sunlight in a form of parallel light after it is concentrated and therefore does not rely on expensive medium such as optic fibers. With the help of a tracking device, sunlight of any incident angle will be reflected in a fixed direction and to a fixed point where the light is reflected further on to the desired destination inside of a building.

Specifically, the invention provides a daylight transmission system for buildings, the system including: dual-axis implementation device, CPU-controller, light position sensor and optical components that include moving and fixed optical components; with the moving optical components including optical light collector and the fixed optical components including first receiver and subsequent receivers.

Optimally, the dual-axis implementation device includes: main shaft, main motor and its affiliated drive device, secondary shaft, secondary motor and its affiliated drive device. Optimally, the optical light collector is installed on the secondary shaft.

Optimally, the dual-axis implementation device drives the optical light collector and makes it rotate around its own central point which is kept fixed in its position in space.

Optimally, the light position sensor is configured to be installed between any two optical components and the normal vector of the plane where the light position sensor lies is parallel to the line linking the central points of the two optical components.

Optimally, the light position sensor is configured as such that its back is facing toward the sky, so that it can receive the sunlight reflected from the optical light collector.

Optimally, the dual-axis implementation device adjusts the status of the system through combined movements of the main shaft and secondary shaft; and the main shaft and secondary shaft intersect each other perpendicularly with their intersection point being fixed in its position any time during the operation of the system.

Optimally, the optical light collector is an optical device that can reflect or refract light.

Optimally, the optical light collector (2) takes the forms of flat mirrors, curved mirrors, prisms and lenses, and/or their combinations.

Optimally, the first receiver (15) is an optical device that can concentrate, diffuse, reflect or refract light.

Optimally, the first receiver (15) takes the forms of lenses, flat mirrors, paraboloid concentrators, curved mirrors, prisms, and/or their combinations.

Optimally, the subsequent receivers (17, 18, 19) are optical devices that can reflect, diffuse or refract light.

Optimally, the subsequent receivers (17, 18, 19) can take the forms of flat mirrors, curved mirrors, prisms, lenses and their combinations.

Optimally, the dual-axis implementation device (1) is controlled by CPU-controller (9) that delivers a closed-cycle control mechanism so as to adjust the status of the dual-axis implementation device (2) in real time.

Optimally, the intersection point of the main shaft (6) and the secondary shaft (3) and the rotating center of the optical light collector (2) coincide.

Optimally, the light position sensor (12) is located on a plane that is located between the optical light collector (2) and the first receiver (15). The light position sensor (12) is allocated on the sensor plane (62) and within the range defined by the largest projection area the optical light collector (2) can achieve on the sensor plane (62). The projection area of the optical light collector (2) on the sensor plane (62) is partially or completed covered by the projection area of the first receiver (15) on the sensor plane (62).

Optimally, the light position sensor (12) is located on a plane that is located between the optical light collector (2) and the first receiver (15), and the main shaft (6) is tilted towards the true north or south; and meanwhile, the angle P (47) between the normal vector (46) of the light position sensor (12) and the plane (39) of the optical light collector (2), the angle T (51) between the axis line (61) of the main shaft (6) and the vertical line (50) perpendicular to the horizontal plane, the Solar Altitude α (60) and the Solar Latitude B (55) are 6 configured to follow the following mathematical relationship:

$$P = 45^\circ + \frac{\operatorname{arctl}\left[(\sin T + K\cos T) \Big/ \sqrt{(\cos T - K\sin T)^2 + L^2}\right.}{2} \quad \text{[Formula 1]}$$

unit: degree

In which:

$$L = \tan(B - 180^\circ); \quad \text{[Formula 2]}$$

and $$K = (\tan\alpha) \times \sqrt{1 + [\tan(B - 180^\circ)]^2} \quad \text{[Formula 3]}$$

Optimally, the light position sensor (12) is configured to be installed between any two optical components, and the main shaft (6) is tilted towards the true north or south; and any optical components located between the optical light collector (2) and the light position sensor (12) are capable of reflecting light; and the projection areas of the two optical components adjacent to the light position sensor (12) on the sensor plane (62) where the light position sensor (12) lies are totally or partially overlapped; and meanwhile the light position sensor (12) is located in the projected area on the sensor plane (62) made by the optical component that reflects light to the light position sensor (12).

Optimally, let in a Euclidean space the number of reflective optical components between the light position sensor (12) and the optical light collector (2) be n, and let the normal vector leaving the light sensitive surface of the light position sensor (12) be i, then i is converted to a new vector I after i has undergone n times of reflection between the above-mentioned optical components; and the angle Q (76) between the vector I (73) and the plane (39) of the optical light collector (2), the angle T (51) between the axis line (61) of the main shaft (6) and the vertical line (50) perpendicular to the horizontal plane, the Solar Altitude α (60) and the Solar Latitude B (55) are configured to follow the mathematical relationship given below:

$$Q = 45^\circ + \frac{\operatorname{arctl}\left[(\sin T + K\cos T) \Big/ \sqrt{(\cos T - K\sin T)^2 + L^2}\right.}{2} \quad \text{[Formula 4]}$$

unit: degree

In which:

$$L = \tan(B - 180^\circ) \quad \text{[Formula 5]}$$

and $$K = (\tan\alpha) \times \sqrt{1 + [\tan(B - 180^\circ)]^2} \quad \text{[Formula 6]}$$

The benefit of this invention is that the system can reflect the incident sunlight to a fixed point and in a fixed direction whilst keeping the light in its parallel form, so that it is possible for sunlight to travel through space without relying on optical mediums and reach deep internal spaces within buildings. The invented system can be installed directly onto the external wall of any building, and be applied within a wide range of buildings. The invented system also dramatically reduces the cost for transmitting daylight compared against currently available systems.

DETAILED DESCRIPTION

Figure 1:
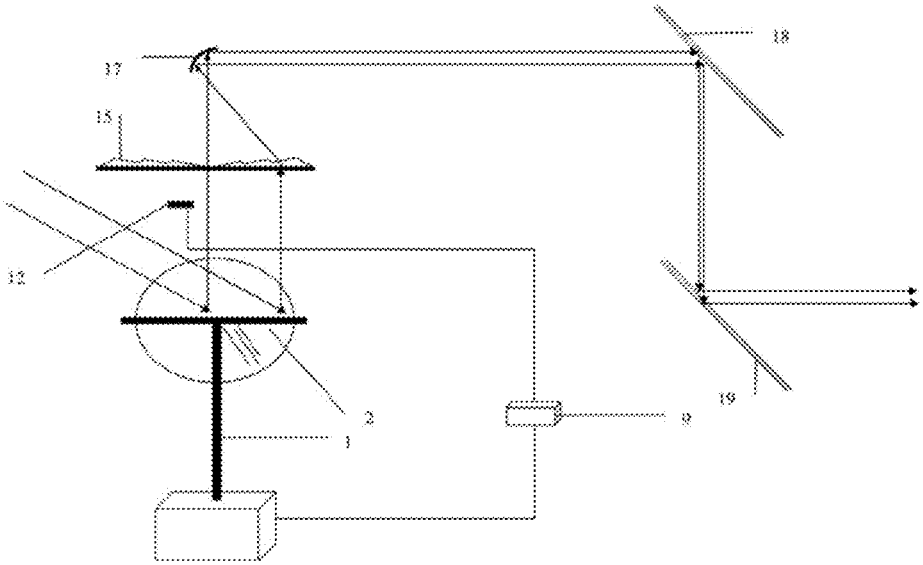
FIG. 1 is an embodiment of this invention.

As shown in FIG. 1, an embodiment of the invented system includes: dual-axis implementation device (1), optical light collector (2), CPU-controller (9), light position sensor (12), first receiver (15) and subsequent receivers (17, 18, 19). The CPU-controller (9) controls the movements of the dual-axis implementation device (1) that in turn drives the optical light collector (2) making it tracking the sun and reflecting the sunbeam onto the light position sensor (12). The CPU-controller (9) controls the movements of the dual-axis implementation device (1) based on the output signal given by the light position sensor (12), making sure that the reflected sunbeam can reach the first receiver (15) at a given incident angle, and is reflected further between subsequent receivers (17, 18, 19). The above process explains how sunbeam is reflected and transmitted by the invented system.

Figure 2:
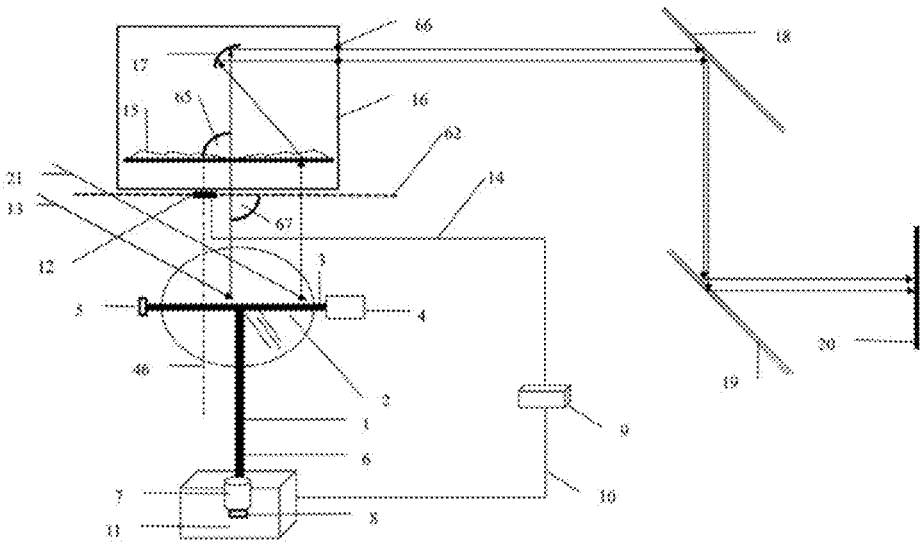
FIG. 2 demonstrates the structure of the invented system and its working mechanism.

FIG. 2 demonstrates the structure of the invented system and its working mechanism. It is noted that although certain preferred configuration and/or components are disclosed in this figure or other figures that follow, the scope of the claims appended hereto is not limited by any of the particular components and/or configurations described herein. As shown in FIG. 1, the optical light collector (2) being an optical device capable of reflecting light is mounted on a secondary shaft (3) of a dual-axis implementation device (2). In this embodiment, the dual-axis implementation device (2) takes the form of a T-type dual-axis system which comprises a main shaft (6) and a secondary shaft (3). The main shaft (6) is driven by the main motor and its affiliated drive device (7) controlled by a main IC driver (8). The secondary shaft (3) is driven by the secondary motor and its affiliated drive device (4) controlled by a secondary IC driver (5). The dual-axis implementation device is supported and/or contained by a mounting device (11). In other embodiments, the dual-axis implementation device can take any form whose main and secondary shaft intersect.

In this embodiment, the optical light collector (2) is a flat mirror; and the first receiver (15) takes the form of a Fresnel lens which is placed in a container (16) with a light exit (66) on it. The bottom side of the container (16) is transparent.

The light position sensor (12) is fixed under the first receiver (15), namely the Fresnel lens, and is parallel to the lens. The subsequent receiver (17) is a concentrator taking the form of a curved mirror that shares the same focal point of the Fresnel lens (15). More subsequent receivers (18, 19) taking the form of flat mirrors are employed in this setting to transmit the sunlight further. In other embodiments, the optical light collector (2) can take the form of not only a flat mirror but also optical devices that can reflect light, such as a curved mirror or a Fresnel lens. The first receiver (15) is of a fixed position and takes the form of a concentrator or a reflector, such as a Fresnel Lens, a mirror or a curved concentrating mirror. The subsequent receivers (17, 18, and 19) are optical devices that are capable of reflecting or refracting light. The typical forms of the subsequent receivers (17, 18, and 19) are flat mirrors, curved mirrors and/or lens.

In this embodiment, the light position sensor (12) is installed between the optical light collector (2) and the first receiver (15). The light position sensor 12) is configured as such that its back is facing toward the sky, so that its front surface can receive the sunlight reflected from the optical light collector (2). The light position sensor (12) is connected to the CPU-controller (9) via signal line (10) and line (14) and sends control signals to the dual-axis implementation device (1). When the system operates, the dual-axis implementation device (1) is configured to control the movements of the optical light collector (2) according to the commands from the CPU-controller (9) and the signals from the light position sensor (12) so as to keep the incident angle (67) of the sunbeam reflected to the light position sensor (12) a constant. The CPU-controller (9) uses signals given by the light position sensor (12) as the base for computing. The CPU-controller (9) is capable of sampling the feedback signals given by the light position sensor (12) in real time, therefore when the incident angle (67) as a parameter needs adjustment, its value can be modified and maintained easily within the CPU-controller (9) framework without altering the actual physical position of the light position sensor (12). Therefore, during the operation of the system, because the incident angle (67) is made a constant, and at the same time the Fresnel lens is parallel to the light position sensor (12), the incident angle (65) between the sunbeam and the Fresnel lens (15) is constant too. As such, sunbeam (13, 21) passes through the convex Fresnel lens (15) with a precise incident angle first, and is then concentrated by a paraboloid concentrator (17) which realigns the rays to form a new bunch of concentrated parallel sunbeam. The concentrated parallel sunbeam then passes through the light exit (66) and meet the subsequent receivers (18, 19). The subsequent receivers (18, 19) then transmit the concentrated parallel sunbeam further by reflecting it to room deep in buildings and as such it will reach the final receiving area (20).

MODE FOR INVENTION

Figure 3:
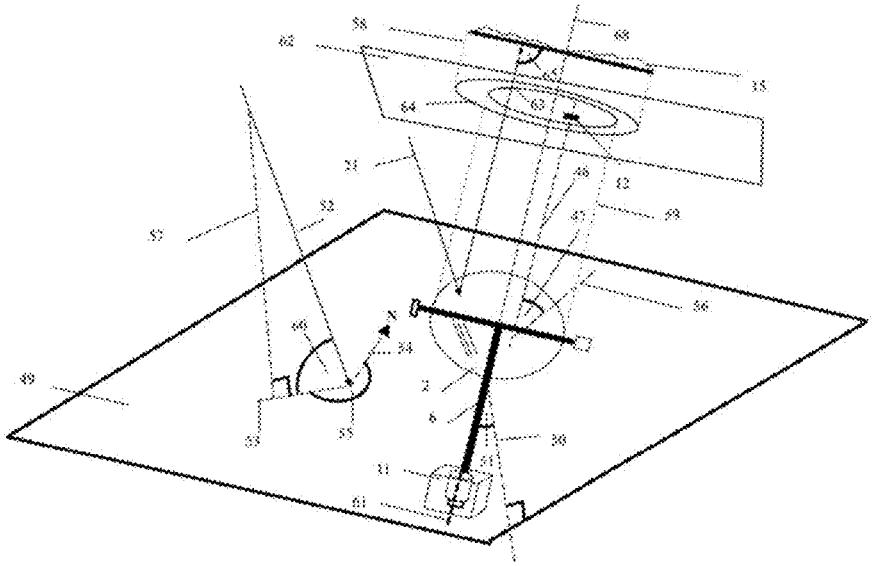
FIG. 3 explains the working mechanism of a preferred embodiment of this invention.

FIG. 3 is another embodiment of the invention and it explains the way it operates. As shown in the FIG. 3, the system is placed on a horizontal plane (49) with the main shaft (6) being tilted towards the true north. The purpose of keeping the main shaft (6) being tilted towards the true north is to avoid the first receiver (15) blocking the sunbeam that is supposed to strike the optical light collector (2). The light position sensor (12) is configured to be installed between the optical light collector (2) and the first receiver (15), and the normal vector (46) of the plane (62) where the light position sensor (12) lies is parallel to the line (68) linking the central points of the two optical components. The angle T (51) between the axis line (61) of the main shaft (6) and the vertical line (50) perpendicular to the horizontal plane is shown in the FIG. 3. In this embodiment, the first receiver (15) is a Fresnel lens and it is configured to be parallel to the plane on which the light position sensor (12) lies.

Two sunbeams (21, 52) are shown in FIG. 3. The projection line (53) in FIG. 3 is the projection of the sunbeam (52) on the horizontal plane (49), and the line (57) is a normal vector of the horizontal plane (49). The angle between the sunbeam (52) and its projection line (53) is the Solar Altitude angle α (60). The angle between the projection line (53) and the true north line (54) is the Solar Latitude angle B (55).

As shown in FIG. 3, the line (58) starts from the rim of the first receiver (15) and is perpendicular to the plane (62) where the light position sensor (12) lies, and it helps to mark the projected area of the first receiver (15) on the plane (62). The line (59) starts from the rim of the flat mirror (2) and is perpendicular to the plane (62) where the light position sensor (12) lies, and it helps to mark the projected area of the flat mirror (2) on the plane (62). It is therefore made clear by the FIG. 3 that the light position sensor (12) is allocated on the sensor plane (62) within the range defined by the largest projection area (63) the mirror (2) can make on the plane (62); and on the plane (62), the projection area (63) of the mirror (2) is partially or completed covered by the projection area (64) of the first receiver (15).

During the course of operation, as long the angle P (47) between the normal (46) of the light position sensor (12) and its projected line (56) on the mirror (2), the angle T (51), Solar Altitude α (60) and Solar Latitude B (55) are made to meet the following requirements as given in the Formulas 7-9 below:

$$P = 45° + \frac{\arctan\left[(\sin T + K\cos T) \Big/ \sqrt{(\cos T - K\sin T)^2 + L^2}\right]}{2} \quad \text{[Formula 7]}$$

unit: degree

In which:

$$L = \tan(B - 180°) \quad \text{[Formula 8]}$$

$$K = (\tan\alpha) \times \sqrt{1 + [\tan(B - 180°)]^2} \quad \text{[Formula 9]}$$

When the requirements as given in the Formulas 7-9 are met, sunbeam (21) striking mirror (2) is reflected onto the light position sensor (12) and the first receiver, namely the Fresnel lens (15) at a precise angle (65). Thereafter, the CPU-controller (9) will continue to monitor the signal given by the light position sensor (12) and adjust the movements of the main shaft (6) and the secondary shaft (3) to ensure the angle (65) between the sunbeam (21) and the Fresnel lens (15) remains a constant regardless of the sun's position in the sky.

Figure 4:
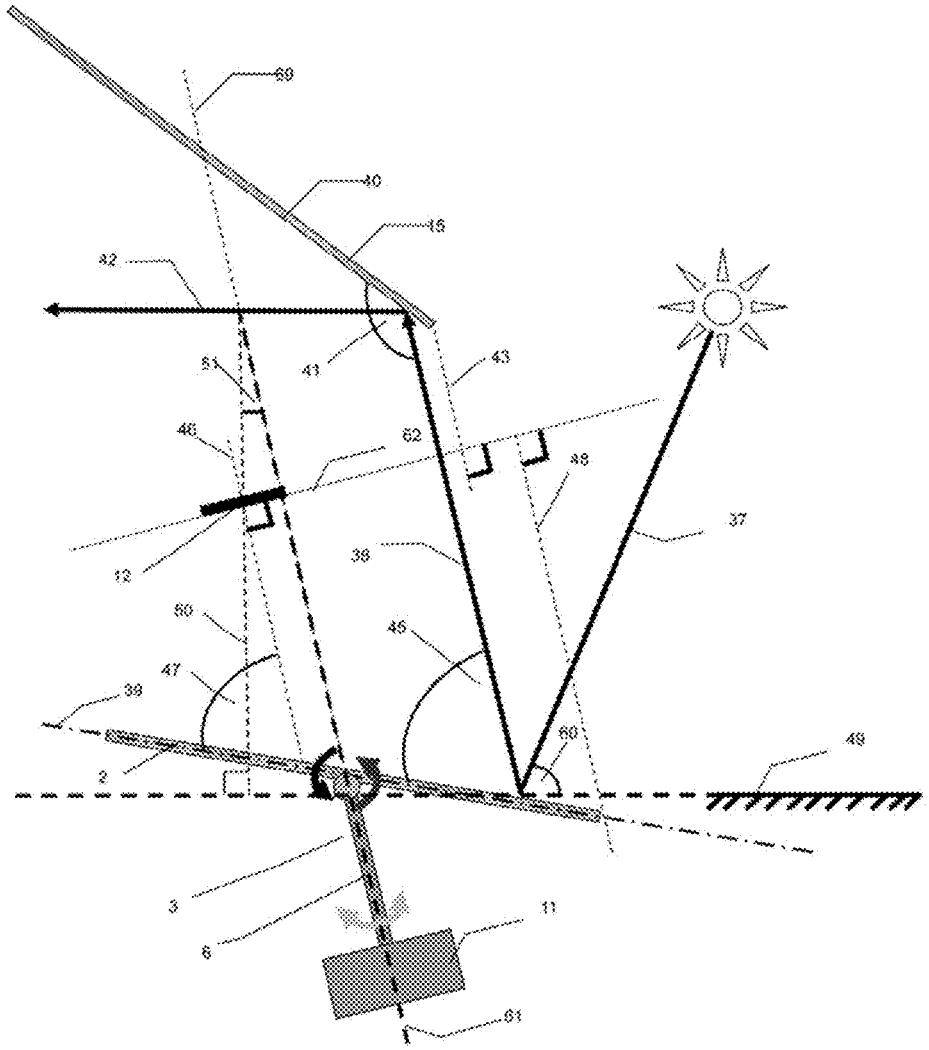
FIG. 4 explains the working method of another preferred embodiment of this invention.

FIG. 4 is another embodiment of the invention. As shown in FIG. 4, in this embodiment, the system remains tilted towards the direction of the true north; yet the difference between FIGS. 3 and 4 is that in this embodiment the first receiver (15) takes the form of a flat mirror (40) instead of a Fresnel lens. The light position sensor (12) is configured to be installed between the mirror (2) and the mirror (40), and the normal vector (46) of the plane (62) where the light position sensor (12) lies is parallel to the line (69) linking the central points of the two optical components. It is therefore made clear by FIG. 4 that the light position sensor (12) is allocated on the sensor plane (62) within the range defined by the largest projection area the mirror (2) can make on the plane (62); and on the plane (62), the projection area of the mirror (2) is partially or completed covered by the projection area of the flat mirror (40).

The perpendicular line (43) starting from the rim of the first receiver (15) and reaching the plane (62), and the perpendicular line (48) starting from the rim of the mirror (2) and reaching the plane (62) help to demonstrate the above-mentioned relationship.

In this embodiment, the angle T (51) between the axis line (61) of the main shaft (6) and the vertical line (50) perpendicular to the horizontal plane is 30 degrees. The angle between the normal vector line (46) of the light position sensor (12) and the plane (39) of the mirror (2) is P (47). As shown in the FIG. 4 the Solar Altitude is α (60). Although the angle B of the Solar Latitude cannot be viewed in this particular figure, it can be found in the FIG. 3 given as the angle B (55). The working mechanism of the system has been explained previously and it remains the same for this embodiment. In this embodiment, mirror (2) rotates in a desired way as the result of the combined movements of the main shaft (6) and the secondary shaft (3) so that the angle P(47) meets the following requirements defined by Formulas 10-12:

$$P = 45^\circ + \frac{\arctan\left[(\sin T + K\cos T)\Big/\sqrt{(\cos T - K\sin T)^2 + L^2}\right]}{2} \quad \text{[Formula 10]}$$

unit: degree

In which:

$$L = \tan(B - 180^\circ) \quad \text{[Formula 11]}$$

$$K = (\tan\alpha) \times \sqrt{1 + [\tan(B - 180^\circ)]^2} \quad \text{[Formula 12]}$$

In this embodiment, as long the above-mentioned requirements are met, at any time during the operation of the system, the sunbeam (37) striking the mirror (2) is reflected onto the light position sensor (12). Thereafter, the CPU-controller (9) continues to adjust the orientation of the mirror (2) through moving the main shaft (6) and the secondary shaft (3) to ensure the incident angle (41) between the sunbeam (38) and the mirror (40) remains constant. As the mirror (40) is fixed in its position, and the incident angle (41) is made constant, the sunbeam (38) leaving the mirror (40) is fixed in its direction too. Eventually, the reflected sunbeam (42) is reflected toward the inner space of the building where it may undergo further reflections and reach its final destination where the space requires daylighting.

Figure 5:
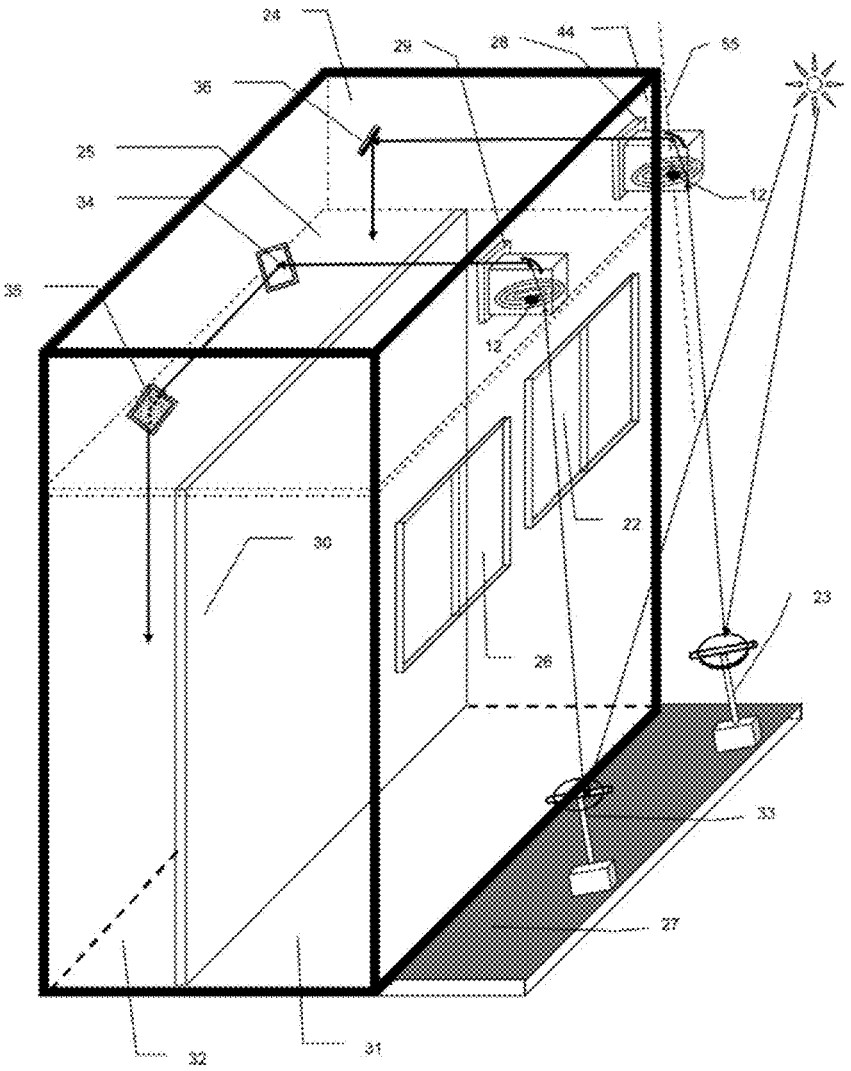
FIG. 5 explains how an embodiment of the invention works in a real building.

FIG. 5 is another embodiment of the invention that demonstrates how the system is applied in a real building and its benefits in daylighting and energy saving. In this embodiment, the system is installed on the south external wall of a building. As shown in FIG. 5, a building has a wall (44) facing the south with two windows (22, 26) on it. Two sets of the system (23, 33) are installed under the windows (22, 26) on the platforms (27) extended from the wall (44), and two containers are installed above the windows through the mounting devices (28,29). The working mechanism of the system and its components has been made clear previously through FIGS. 2 to 4. In FIG. 5, the upper-plane (24) is the real ceiling and the lower-plane (25) is the suspended ceiling. Wall (30) divides the indoor space into two parts, namely the southern part (31) with windows (22, 26) and the northern part (32) which is windowless and hence lack of daylight. As shown in FIG. 5, sunbeam is reflected by the system (23) to the internal space of the building and then travels to the north through the space between the real and the suspended ceilings. In the space over the suspended ceiling, the reflected sunbeam strikes a subsequent receiver (17), namely a mirror (36), and is reflected downwards by it into the northern space (32) where it is used for daylighting. To summarize, FIG. 5 demonstrates how sunbeam can be distributed inside of a building. When a sunbeam is transmitted into a building by the system (33), it hits reflectors (34, 35) where it is transmit further into the northern area (32) where there is a lack of natural daylighting throughout the year.

Experimental application data show that the invented system is of out-standing performance in daylighting and energy saving. In this embodiment, the system provides a sunbeam collection area of about one squared meter, and concentrates the light in a ratio of 150 to 1; and after the concentration, the sunbeam becomes a beam of the diameter of about 100 mm. Suppose there is a 28-story building of the height of 100 meters in need of daylighting in its underground space directly underneath the building, then the sunbeam need to travel 100 meters from the top of the building to the underground space. Then as the accuracy of the system in which sunbeam is transmitted is about 0.01 degree, after having traveled 100 meters, the sunbeam makes a deviation of about 17.5 mm and delivers an overall efficiency of about 82.5%; therefore the peak power of the system is about 800 W in the brightest summer day and it is equivalent to 2400 W of florescent lumps and enough to light up an area of about 240 square meters.

Figure 6:
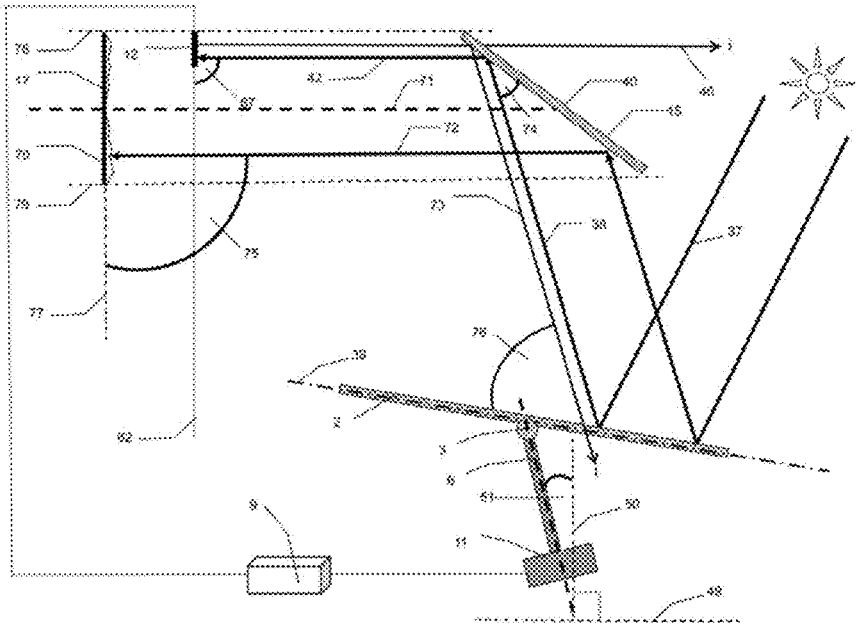
FIG. 6 explains in detail the working method of another embodiment of this invention.

FIG. 6 shows another embodiment of this invention. In this embodiment, the system is 30-degree tilted towards the true north. The light position sensor (12) is installed between two optical components, namely the first receiver (15) and the subsequent receiver (17). The first receiver (15) is a mirror (40), and the subsequent receiver (17) is a Fresnel lens (70). FIG. 6 shows the Fresnel lens plane (77) and two vertical lines (78, 79) perpendicular to the plane. As indicated by the vertical lines (78, 79), the projected area of the mirror (40) on the plane (62) where the light position sensor lies and that of the Fresnel lens (70) on the plane (62) overlap. The light position sensor (12) is located on the sensor plane (62) and within the projected area made by the optical component, namely the mirror (40) that reflects light to the light position sensor (12). The normal vector (46) of the light position sensor (12) lies is parallel to the line (71) linking the central points of the mirror (40) and the Fresnel lens (70).

In this embodiment, an optical component, namely the mirror (40) lies between the light position sensor (12) and the optical light collector (2). In this case, the mirror (40) can be treated as a mirror in a Euclidean space. As shown in FIG. 6, the vector i is represented by the vector line (46) that is normal to the plane of the light position sensor (12) with its direction leaving the sensor surface. As shown in the figure, vector i undergoes one reflection in the Euclidean space when it strikes the mirror, and is converted to a new vector I (73). The angle Q (76) is the angle between the vector I (73) and the plane (39) of the optical light collector (2).

Then, during the operation of the system, the main shaft (6) and the secondary shaft (3) rotate to adjust the orientation of the mirror (2) to the purpose of meeting the following requirements given by Formulas 13-15:

$$P = 45^\circ + \frac{\arctan\left[(\sin T + K\cos T) \Big/ \sqrt{(\cos T - K\sin T)^2 + L^2}\right]}{2} \quad \text{[Formula 13]}$$

unit: degree

In which:

$$L = \tan(B - 180^\circ); \quad \text{[Formula 14]}$$

and $$K = (\tan\alpha) \times \sqrt{1 + [\tan(B - 180^\circ)]^2} \quad \text{[Formula 15]}$$

In this embodiment, as long the requirements given by Formulas 13-15 are met, at any time the sunbeam (37) will be reflected firstly by the mirror (2) and then by the mirror (40) and eventually reach the light position sensor (12). The CPU-controller (9) adjusts the movements of the main shaft (6) and the secondary shaft (3) according to the feedback signals from the light position sensor (12), so as to make sure that the sunbeam leaving the mirror (2) strikes the mirror (40) at a fixed incident angle (74). As the mirror (40) is fixed in its position, it reflects sunbeam (38) and produces a new beam (42) with a fixed direction. Thereafter, the beam (42) strikes light position sensor (12) and produces feedback signals. Then, the CPU-controller (9) to adjust the movements of the main shaft (6) and the secondary shaft (3) according to the feedback signals, so as to make sure that the angle (67) between the sunbeam (42) and position sensor plane (62) remains a constant value. Because the CPU-controller (9) is capable sampling the feedback signals given by the light position sensor (12), when the desired incident angle (67) as a parameter needs adjustment, its value can be modified and maintained easily within the CPU-controller (9) framework without altering the actual physical position the light position sensor (12). Therefore, during the operation of the system, because the incident angle (67) is made a constant, and at the same time the Fresnel lens is parallel to the light position sensor (12), the incident angle (75) between the sunbeams (42, 72) and the Fresnel (70) is constant too. As such, regardless the sun's position in the sky, the sunbeams (42, 72) pass through the Fresnel lens (70) at a fixed incident angle (75), and be transmitted further multiple subsequent receivers so as to achieve the purpose of reaching and lighting a indoor area with natural light.

The system drives the optical light collector to track the sun, making sure it forms certain angle with the incident sunbeam and reflects the sunbeam at a given direction to subsequent receivers to the purpose of transmitting the sunlight. The transmitted sunlight is basically parallel light and therefore can travel through the air for a long distance without relying on media such as optic fiber or light-pipes. The main character of the system is that it controls the orientation of the optical light collector using a real-time and closed-cycle control mechanism, and makes sure sunbeams are reflected to the first receiver and subsequent receivers in precise angles so that the sunbeams can be transmitted to areas deep in building and applied there for lighting.

To summarize, as demonstrated by the above-mentioned embodiments, the invented system uses close-cycle control mechanism to track the direction of the sunbeam dynamically, and ensures the beam is transmitted in a form of parallel light and in a given direction the help of optic fibers. Systems developed from the invented system can be used to collect sunlight available on the external walls of buildings and transmit the light through existing windows and spaces available above room ceiling level. The daylighting system can therefore integrated into buildings and transmit sunbeams without relying on media such as optic fibers. Because the invented system can be installed near to the external wall or façade of any building, and all of its moving parts have a fixed central point and all of its optical components are placed separately, the system is subject to minimum effect due to the wind. Multiple systems of the invented daylighting system can be used on walls facing different directions so as to provide a backed-up solution that ensures a constant provision of daylight into the building regardless of the sun's position in the sky.

The invention is not limited to the embodiments discussed above. The above description of the embodiment is aimed at describing and explaining the technical scheme involved in the invention. The embodiments given above are used to reveal the best practice for realizing the invention, so that techniques in the field can be applied in the embodiment of the invention, and a variety of alternative ways can be used to achieve the purpose of the present invention. Changes or substitutions based on the present invention shall also be considered to fall into the scope of protection of the present invention.

What is claimed is:

1. A daylight transmission system for buildings, comprising a dual-axis implementation device, a CPU-controller, a light position sensor and optical components; wherein the optical components include moving and fixed optical components; wherein the moving optical components includes an optical light collector and wherein the fixed optical components including a first receiver and one or more subsequent receiver, wherein the dual-axis implementation device includes: a main shaft, a main motor and its affiliated drive device, a secondary shaft, a secondary motor and its affiliated drive device, and further wherein the light position sensor is provided between the optical light collector and the first receiver, and the main shaft is tilted towards the true north or south; wherein an angle P between the normal vector of the light position sensor and a plane of the optical light collector, an angle T between the axis line of the main shaft and the vertical line perpendicular to the horizontal plane, a Solar Altitude $\alpha$ and a Solar Latitude B are configured to follow the following mathematical relationship:

$$P = 45^\circ + \frac{\arctan\left[(\sin T + K\cos T) \Big/ \sqrt{(\cos T - K\sin T)^2 + L^2}\right]}{2}$$

in which:

unit is degree;

$L = \tan(B - 180^\circ)$; and $K = (\tan\alpha) \times \sqrt{1 + [\tan(B - 180^\circ)]^2}$.

2. The daylight transmission system of claim 1, wherein the optical light collector is installed on the secondary shaft.

3. The daylight transmission system of claim 2, wherein the dual-axis implementation device adjusts the status of the system through combined movements of the main shaft and secondary shaft; and the main shaft and secondary shaft intersect each other perpendicularly with their intersection point being fixed in its position any time during the operation of the system.

4. The daylight transmission system of claim 3, wherein the intersection point of the main shaft and the secondary shaft coincides with the rotating center of the optical light collector.

5. The daylight transmission system of claim 1, wherein the dual-axis implementation device drives the optical light collector and makes it rotate around its own central point, wherein the physical location of the central point is kept unchanged in space.

6. The daylight transmission system of claim 5, wherein the dual-axis implementation device adjusts the status of the system through combined movements of the main shaft and secondary shaft; and the main shaft and secondary shaft intersect each other perpendicularly with their intersection point being fixed in its position any time during the operation of the system.

7. The daylight transmission system of claim 6, wherein the intersection point of the main shaft and the secondary shaft coincides with the rotating center of the optical light collector.

8. The daylight transmission system of claim 1, wherein the light position sensor is configured to be installed between any two optical components and the normal vector of a plane where the light position sensor lies is parallel to the line linking the central points of the two optical components.

9. The daylight transmission system of claim 8, wherein the light position sensor is provided between the optical light collector and the first receiver and allocated on the sensor plane and within the range defined by the maximum projection area of the optical light collector projecting on the sensor plane; wherein the projection area of the optical light collector on the sensor plane is partially or completed covered by the projection area of the first receiver on the sensor plane.

10. The daylight transmission system of claim 8, wherein the light position sensor is provided between any two optical components, and the main shaft is tilted towards the true north or south; wherein any optical component located between the optical light collector and the light position sensor is capable of reflecting light; wherein the projection areas of the two optical components adjacent to the light position sensor on the sensor plane where the light position sensor lies are totally or partially overlapped; and wherein the light position sensor is located within the projected area on the sensor plane made by the optical component that reflects light to the light position sensor.

11. The daylight transmission system of claim 1, wherein the light position sensor is configured as such that its back is facing toward the sky, so that it can receive the sunlight reflected from the optical components.

12. The daylight transmission system of claim 1, wherein the dual-axis implementation device adjusts the status of the system through combined movements of the main shaft and secondary shaft; and the main shaft and secondary shaft intersect each other perpendicularly with their intersection point being fixed in its position any time during the operation of the system.

13. The daylight transmission system of claim 12, wherein the intersection point of the main shaft and the secondary shaft coincides with the rotating center of the optical light collector.

14. The daylight transmission system of claim 1, wherein the optical light collector is an optical device that can reflect or refract light.

15. The daylight transmission system of claim 14, wherein the optical light collector is a flat mirror, a curved mirror, a prism, a lens, or a combination thereof.

16. The daylight transmission system of claim 1, wherein the first receiver is an optical device that can concentrate, diffuse, reflect or refract light.

17. The daylight transmission system of claim 16, wherein the first receiver is a lens, a flat mirror, a paraboloid concentrator, a curved mirror, a prism, and/or their combinations.

18. The daylight transmission system of claim 1, wherein the subsequent receivers are optical devices that can reflect, diffuse or refract light.

19. The daylight transmission system of claim 18, wherein the subsequent receivers are flat mirrors, curved mirrors, prisms, lenses and/or their combinations.

20. The daylight transmission system of claim 1, wherein the dual-axis implementation device is closed-cycle-controlled by the CPU-controller which thus adjusts the status of the dual-axis implementation device in real time.

21. The daylight transmission system of claim 1, wherein the light position sensor is provided between the optical light collector and the first receiver and allocated on the sensor plane and within the range defined by the maximum projection area of the optical light collector projecting on the sensor plane; wherein the projection area of the optical light collector on the sensor plane is partially or completed covered by the projection area of the first receiver on the sensor plane.

22. The daylight transmission system of claim 1, wherein the light position sensor is provided between any two optical components, and the main shaft is tilted towards the true north or south; wherein any optical component located between the optical light collector and the light position sensor is capable of reflecting light; wherein the projection areas of the two optical components adjacent to the light position sensor on the sensor plane where the light position sensor lies are totally or partially overlapped; and wherein the light position sensor is located within the projected area on the sensor plane made by the optical component that reflects light to the light position sensor.

23. A daylight transmission system for buildings, comprising a dual-axis implementation device, a CPU-controller, a light position sensor and optical components; wherein the optical components include moving and fixed optical components; wherein the moving optical components includes an optical light collector and wherein the fixed optical components including a first receiver and one or more subsequent receiver, wherein the dual-axis implementation device includes: a main shaft, a main motor and its affiliated drive device, a secondary shaft, a secondary motor and its affiliated drive device, wherein the dual-axis implementation device adjusts the status of the system through combined movements of the main shaft and secondary shaft and the main shaft and secondary shaft intersect each other perpendicularly with their intersection point being fixed in its position any time during the operation of the system, and further comprising letting in a Euclidean space the number of reflective optical components between the light position sensor and the optical light collector be n, and letting the normal vector leaving the light sensitive surface of the light position sensor be i, then: i is converted to a new vector I after i has undergone n times of reflection between the above-mentioned optical components; and the angle Q between the vector I and the plane of the optical light collector, the angle T between the axis line of the main shaft and the vertical line perpendicular to the horizontal plane, the Solar Altitude α and the Solar Latitude B are configured to follow the mathematical relationship given below:

$$Q = 45° + \frac{\operatorname{arct}\left[(\sin T + K\cos T) \Big/ \sqrt{(\cos T - K\sin T)^2 + L^2}\right]}{2}$$

in which:
unit is degree;

$L=\tan(B-180°)$; and $K=(\tan\alpha)\times\sqrt{1+[\tan(B-180°)]^2}$.

24. The daylight transmission system of claim 23, wherein optical light collector is installed on the secondary shaft, and the intersection point of the main shaft and the secondary shaft coincides with the rotating center of the optical light collector.

25. A daylight transmission system for buildings, comprising a dual-axis implementation device, a CPU-controller, a light position sensor and optical components; wherein the optical components include moving and fixed optical components; wherein the moving optical components includes an optical light collector and wherein the fixed optical components including a first receiver and one or more subsequent receiver, wherein the light position sensor is configured to be installed between any two optical components and the normal vector of a plane where the light position sensor lies is parallel to the line linking the central points of the two optical components, and further wherein the light position sensor is provided between the optical light collector and the first receiver, and the main shaft is tilted towards the true north or south; wherein an angle P between the normal vector of the light position sensor and a plane of the optical light collector, an angle T between the axis line of the main shaft and the vertical line perpendicular to the horizontal plane, a Solar Altitude α and a Solar Latitude B are configured to follow the following mathematical relationship:

$$P = 45° + \frac{\operatorname{arct}\left[(\sin T + K\cos T) \Big/ \sqrt{(\cos T - K\sin T)^2 + L^2}\right]}{2}$$

in which:
unit is degree;

$L=\tan(B-180°)$; and $K=(\tan\alpha)\times\sqrt{1+[\tan(B-180°)]^2}$.

26. A daylight transmission system for buildings, comprising a dual-axis implementation device, a CPU-controller, a light position sensor and optical components; wherein the optical components include moving and fixed optical components; wherein the moving optical components includes an optical light collector and wherein the fixed optical components including a first receiver and one or more subsequent receiver, wherein the light position sensor is configured to be installed between any two optical components and the normal vector of a plane where the light position sensor lies is parallel to the line linking the central points of the two optical components, further comprising letting in a Euclidean space the number of reflective optical components between the light position sensor and the optical light collector be n, and letting the normal vector leaving the light sensitive surface of the light position sensor be i, then: i is converted to a new vector I after i has undergone n times of reflection between the above-mentioned optical components; and the angle Q between the vector I and the plane of the optical light collector, the angle T between the axis line of the main shaft and the vertical line perpendicular to the horizontal plane, the Solar Altitude α and the Solar Latitude B are configured to follow the mathematical relationship given below:

$$Q = 45° + \frac{\operatorname{arct}\left[(\sin T + K\cos T) \Big/ \sqrt{(\cos T - K\sin T)^2 + L^2}\right]}{2}$$

in which:
unit is degree;

$L=\tan(B-180°)$; and $K=(\tan\alpha)\times\sqrt{1+[\tan(B-180°)]^2}$.

* * * * *